US005296834A

United States Patent [19]

Urban

[11] Patent Number: 5,296,834

[45] Date of Patent: Mar. 22, 1994

[54] THERMOSTATIC SWITCH AND BIMETALLIC DISC ASSEMBLY THEREFOR

[75] Inventor: Anthony F. Urban, Warren, R.I.

[73] Assignee: Ellmwood Sensors, Inc., Pawtucket, R.I.

[21] Appl. No.: 74,932

[22] Filed: Jun. 10, 1993

[51] Int. Cl.[5] ..... H01H 37/04; H01H 37/52

[52] U.S. Cl. ..... 337/372; 337/354; 337/380

[58] Field of Search ..... 337/372, 380, 112, 113, 337/381, 365, 348, 354

[56] References Cited

U.S. PATENT DOCUMENTS 4,754,252 6/1988 Craig, III ..... 337/380

4,952,901 8/1990 Chrupcala et al. ..... 337/372

*Primary Examiner*—Harold Broome

*Attorney, Agent, or Firm*—Salter, Michaelson & Benson

[57] ABSTRACT

A bimetallic disc assembly for a bimetallic disc-actuated thermostatic switch includes a disc retainer, a bimetallic disc received in assembled position on the disc retainer and a metallic retainer cap for retaining the disc in assembled position on the disc retainer and for securing the assembly to the body portion of the thermostatic switch. The disc retainer is adapted to minimize heat flow from the metallic cap to the disc retainer by minimizing the areas of contact between the disc retainer and the cap. The disc retainer is integrally formed from a ceramic material and it includes a central hub having an axial bore extending therethrough, a circular flange extending radially outwardly from the hub, a circular shoulder extending upwardly from the flange, and a peripheral rim extending upwardly from the shoulder. The peripheral rim includes a horizontal edge with a plurality of circumferentially spaced projections or bumps which extend upwardly therefrom. The metal cap is received on the disc retainer and rests upon the projections or bumps which effectively reduce the contact area between the cap and the retainer and thereby minimize the transfer of heat from the cap to the disc retainer. By reducing the heat transfer from the cap to the retainer, heat is more easily transferred from the metallic cap to the bimetallic disc, thereby improving response time.

6 Claims, 2 Drawing Sheets

THERMOSTATIC SWITCH AND BIMETALLIC DISC ASSEMBLY THEREFOR

BACKGROUND AND SUMMARY OF THE INVENTION

The instant invention relates to bimetallic disc-actuated thermostatic switches and more particularly to a bimetallic disc assembly therefor which is adapted for minimizing the response time of the switch.

It is known that many household, office and industrial machines and appliances now include highly sensitive electrical components that may be damaged by thermal overload conditions. In this regard, thermostatic switches have heretofore been known as high limit devices for preventing thermal overload damage to machines or appliances containing such sensitive electrical components. In this regard, thermostatic switches are operative for interrupting the electrical connections of the main heat generating components of the machine or appliance in response to thermal overload conditions. However, since it has been found that thermal overload conditions can develop very rapidly, it is essential for the thermostatic switches which are used in these devices to have a rapid response time in order to avoid damage to the machine components.

The U.S. patents to Craig, III U.S. Pat. No. 4,754,252 and Chrupcala U.S. Pat. No. 4,952,901, which represent the closest prior art to the subject invention of which the applicant is aware, are specifically concerned with minimizing response time in thermostatic switches. The Craig patent concerns a disc retainer and cap assembly which cooperate to increase air flow across the surface of the bimetallic disc. The cap has a plurality of air circulation vents extending therethrough and the disc support or retainer is designed so that exterior ambient air can pass through the air circulation openings and across the underside of the bimetallic disc to provide increased responsiveness to ambient conditions. While the Craig device is effective for reducing response time, it also presents several design problems which make it difficult to assemble. In particular, the radial disc supports must be radially aligned with the areas between the vents so that the disc supports do not block air flow through the vents. It can be appreciated that this rotational alignment is very difficult to maintain while the cap is positioned on the switch body and crimped in place.

The patent to Chrupcala discloses a disc retainer and aluminum cap assembly which is adapted to minimize the conduction of heat from the bimetallic disc to the disc retainer. The disc retainer includes a central hub portion, a plurality of fingers which radiate outwardly from the hub portion, a plurality of disc retainer projections on the fingers and a plurality of disc support shoulders on the fingers adjacent the disc retainer projections. The fingers have open notches therebetween for reducing the cross-sectional area of the disc retainer which may conduct heat from the bimetallic disc to the body portion of the thermostatic switch. The aluminum cap includes an end wall portion having an enlarged opening therein and a skirt portion having a plurality of apertures or slots therein which reduce the cross-sectional area of the skirt for conducting heat from the bimetallic disc to the body portion of the switch. The Chrupcala device also presents several problems. More specifically, the material from which the disc retainer can be formed is limited to plastic thermosetting materials which are easy to mold and resistant to breakage during manufacturing and handling. The problem here is that thermosetting materials have a relatively low melting point which limits use of the switch to applications where temperature does not exceed 375–400 degrees F. In addition, it has been found that it is difficult to crimp the aluminum perforated cap, and it has further been found that the crimping of the cap tends to deform or warp the cap, which may result in pressure on the disc which in turn may adversely affect the snap-action thereof. It is pointed out that these types of disc retainers cannot be formed from a ceramic material because the fingers would be very brittle and would very easily break during the manufacturing process.

The instant invention provides an improved bimetallic disc assembly for a bimetallic disc-actuated thermostatic switch. In this regard, the disc assembly includes an integrally molded ceramic disc retainer, a bimetallic disc which is received on the disc retainer, and a metallic cap which is received over the disc retainer. The disc retainer is adapted to minimize heat flow from the metallic cap to the disc retainer by minimizing the areas of contact between the disc retainer and the cap. The ceramic construction of the instant disc retainer also allows it to be used in a broader temperature range than the prior art plastic disc retainers. In particular, the instant disc retainer comprises a central hub having an axial bore extending therethrough, a circular flange extending radially outwardly from the central hub, a circular support shoulder extending upwardly from the flange, and a peripheral rim extending upwardly from the support shoulder. The peripheral rim has a plurality of circumferentially spaced projections, or bumps which extend upwardly therefrom. The metal cap is received on the disc retainer so that it rests on top of the projections or bumps on the peripheral rim. The bumps effectively minimize the contact area between the cap and the disc retainer and thereby reduce the transfer of heat from the cap to the disc retainer. By reducing the transfer of heat from the cap to the disc retainer, heat is more quickly transferred from the cap to the bimetallic disc, thereby improving response time.

Accordingly, it is an object of the instant invention to provide a thermostatic switch which has a quick response time to changes in wide ranges of ambient temperature conditions.

It is another object to provide a disc retainer for a thermostatic switch which may be made of ceramic and which is adapted to increase response time to changes in ambient temperature conditions.

It is still another object to provide a disc retainer which minimizes contact area between the cap and disc retainer.

It is still another object to provide a thermostatic switch which can be used in a broad range of temperatures.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
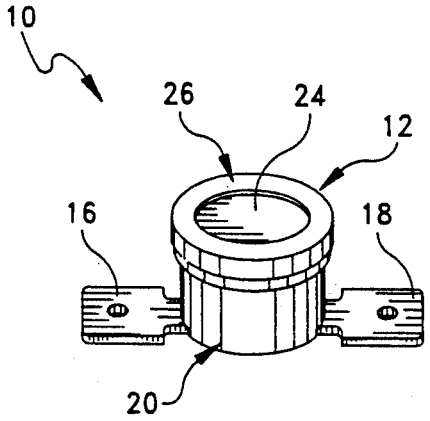
FIG. 1 is a perspective view of the thermostatic switch of the instant invention.
Figure 2:
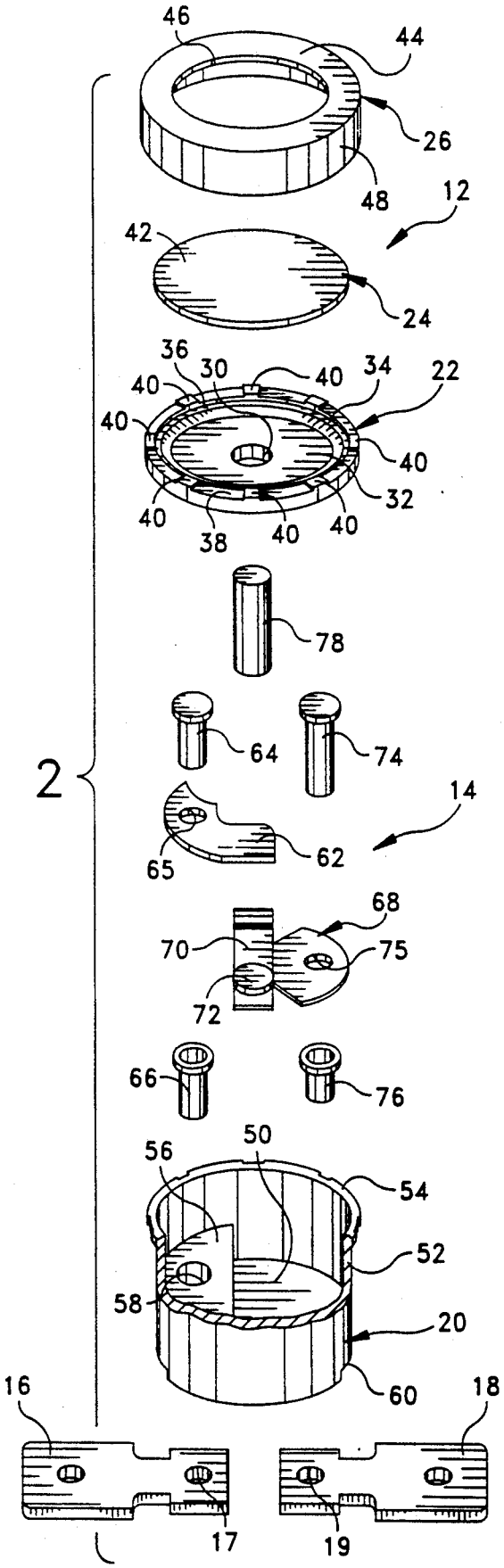
FIG. 2 is an exploded perspective view showing the components of this switch.
Figure 3:
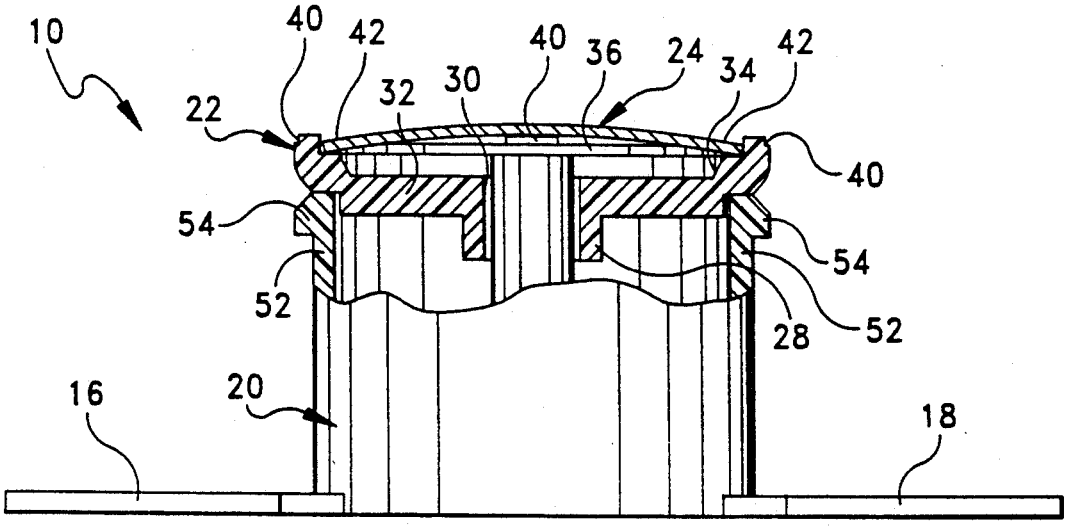
FIG. 3 is a side elevational view of the switch without the cap, partially in cross-section and with portions broken away for purposes of illustration.
Figure 4:
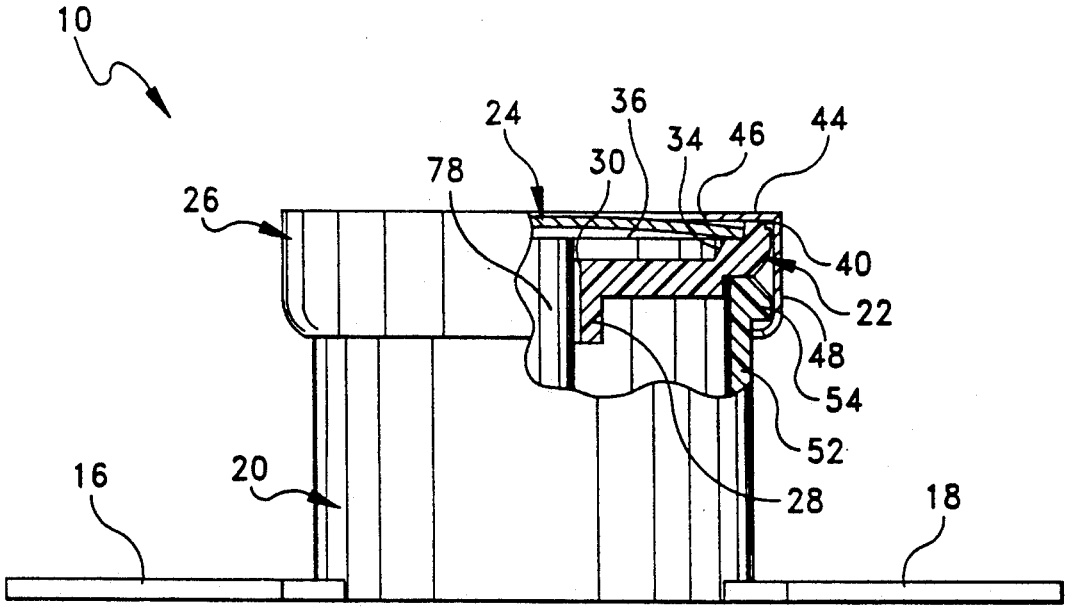
FIG. 4 is a similar view with the cap mounted on the disc retainer.

Referring now to the drawings, a bimetallic disc-actuated thermostatic switch which includes the bimetallic disc assembly of the instant invention is illustrated and generally indicated at 10 in FIGS. 1 through 4. The thermostatic switch 10 includes a bimetallic disc assembly generally indicated at 12, a switching assembly generally indicated at 14, including first and second external electrical terminals 16 and 18, respectively, and a switch body generally indicated at 20. The disc assembly includes a disc retainer generally indicated at 22, a bimetallic disc 24, and a metallic cap generally indicated at 26. The disc retainer 22 and switching assembly 14 are assembled with the switch body 20 so that the bimetallic disc 24 is operative for actuating the switching assembly 14 for selectively effecting and interrupting electrical continuity between the electrical terminals, 16 and 18, in response to a predetermined temperature condition.

The disc retainer 22 is preferably integrally molded from a suitable ceramic material and it includes a central hub portion 28 having an axial bore 30 extending therethrough, a circular flange portion 32 extending radially outwardly from the hub portion 28, a circular shoulder portion 34 extending upwardly from the peripheral edge of the flange 32, and a peripheral rim portion 36 extending upwardly from the shoulder portion 34. The peripheral rim portion 36 includes a horizontal edge 38 and a plurality of projections or bumps 40 on the horizontal edge 38. The ceramic construction of the instant disc retainer 22 provides a distinct advantage over the prior art plastic disc retainers in that it is not limited by temperature considerations which must be taken into account when using thermosetting plastic disc retainers. The ceramic construction of the disc retainer 22 thus permits the instant thermostatic switch 10 to be used in a broad band of temperatures which range from cryogenic to greater than 600 degrees F.

The bimetallic disc 24 preferably comprises a conventional bimetallic disc which is flex-responsive to a predetermined temperature condition as a result of the differences in thermal expansion properties of the metals from which it is formed. The disc 24 is dimensioned so that a peripheral edge 42 is received and supported on the shoulder portion 34 of the disc retainer 22.

The retainer cap 26 is preferably made from a suitable sheet metal and it includes a substantially flat end wall portion 44 having an enlarged central opening 46 therein, and a skirt or sidewall portion 48 which deepens from the end wall portion 44. The cap 26 is dimensioned to be received on the disc retainer 22 for retaining the bimetallic disc 24 in assembled position on the disc retainer 22. More specifically, the cap 26 is received on the horizontal edge portion 38 of the disc retainer 22 so that it rests on top of the projections or bumps 40 thereon. It has been found that the metal cap 26 has a large surface area which is directly exposed to ambient air and that it is therefore extremely effective in accumulating heat from the ambient air. The bumps 40 on the disc retainer 22 effectively minimize the contact area between the metal cap 26 and the ceramic retainer 22 and thereby minimize the transfer of heat from the cap 26 to the disc retainer 22. By reducing the transfer of heat from the cap 26 to the disc retainer 22, the heat accumulated in the cap 26 is more easily transferred from the cap 26 to the bimetallic disc 24, thereby improving response time.

The body portion 20 of the switch 10 is generally of conventional construction and it is preferably manufactured from a suitable high temperature insulating material such as a phenolic or ceramic, as generally used on thermostatic controls. The switch body 20 includes a bottom wall portion 50, an upstanding sidewall portion 52, and an enlarged upper lip 54 on the terminal edge of the sidewall portion 52. An inner shoulder 56 having an aperture 58 therethrough is formed in the interior of the body portion 20 and a recess 60 is formed on the outer side of the bottom wall 50.

The switching assembly 14 is received and assembled in the body portion 20 and it includes a fixed contact 62 which is secured to the inner shoulder 56 with a rivet 64 which passes through opening 65 in the fixed contact 62. The rivet 64 is received in an eyelet 66 which is in turn received in the aperture 58. The first terminal 16 is received in the recess 60 on the outer side of the bottom wall 50 and the rivet 64 extends through aperture 17 in the first terminal 16 for securing the first terminal 16 to the body portion 20 so that it is electrically connected to the fixed contact 62 through the eyelet 66 and the rivet 64. The switching assembly 14 further comprises a moveable contact assembly generally indicated at 68 including a resilient contact arm 70 having a moveable contact element 72 thereon, a rivet 74 and an eyelet 76. The rivet 74 extends through aperture 75 in the base portion of the moveable contact assembly 68 and it is received in the eyelet 76 which is in turn received in an aperture (not shown) in the bottom wall 50 of the body portion 20. The second terminal 18 is assembled in the recess 60 in the bottom wall 50 so that it is spaced from the first terminal 16 and the rivet 74 passes through aperture 19 in the second terminal 18 for securing it to the body portion 20. When the second terminal 18 and the moveable contact assembly 68 are secured to the body portion 20 in this manner, the rivet 74 and eyelet 76 effectively establish electrical communication between the moveable contact assembly 68 and the second terminal 18. When the moveable contact assembly 68 is assembled in the body portion 20 in this manner, the arm 70 is normally positioned so that the contact element 72 engages the fixed contact 62 to establish electrical continuity between the first and second terminals, 16 and 18 respectively. The resilient arm 70 is deflectable downwardly to separate the moveable contact element 72 from the fixed contact element 62 in order to interrupt electrical continuity between the first and second terminals, 16 and 18 respectively. Specifically, a transfer pin 78 extends through aperture 30 into engagement with disc 24 whereby flexing of the latter in response to a predetermined temperature condition causes the transfer pin to move the moveable contact arm 70 downwardly to break electrical continuity.

The disc assembly 12 is assembled on the body portion 20 so that a peripheral edge of the flange portion 32 of the disc retainer 22 rests on the upper edge of the lip 54 and the lower edge portion of the skirt portion 48 of the cap 26 is crimped inwardly around the lower edge of the lip 54 to permanently secure the disc assembly 12 to the body portion 20. As previously stated, the disc assembly 12 is assembled with the body portion 20 so that the transfer pin 78 is received in the axial bore 30 in the disc retainer 22, and accordingly, the transfer pin 78 extends between the bimetallic disc 24 and the resilient contact arm 70. Further, the transfer pin 78 is dimensioned so that when the bimetallic disc 24 is in an "upwardly" flexed disposition, the arm 70 is in an "at rest" position wherein the moveable contact element 72 engages the fixed contact 62. However, when the disc 24 snaps or flexes to a "downwardly" flexed position in response to a predetermined temperature condition, the transfer pin 78 moves the arm 70 downwardly to move the moveable contact element 72 to a position of spaced disengagement from the fixed contact 62. Accordingly, electrical continuity between the first and second terminals, 16 and 18 respectively, can be established or interrupted in a conventional manner in response to a predetermined temperature condition.

It is seen therefore that the instant invention provides an effective bimetallic disc assembly for a bimetallic disc-actuated thermostatic switch. The disc retainer is provided with a plurality of bumps or projections which minimize the contact area between the metal cap and the disc retainer thereby reducing the transfer of heat from the cap to the disc retainer. By reducing the transfer of heat from the cap to the disc retainer, ambient heat accumulated in the cap can more easily flow from the cap to the bimetallic disc thereby making the disc more responsive to changes in ambient temperature and improving response time. In addition, the construction of the disc retainer lends itself to being made of ceramic, since there are no parts that are susceptible to breakage, and since ceramic may be effectively used in high temperature applications, this is a decided advantage. For these reasons the bimetallic disc assembly and disc retainer of the instant invention are thought to represent significant advancements in the art which have substantial commercial merit.

While there is shown and described herein certain specific structure(s) embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A disc retainer for a thermostatic switch of the type actuated by a bimetallic disc comprising:

a circular flange portion having an axial bore extending therethrough;

a circular shoulder portion extending upwardly from a first side of said flange portion, said shoulder portion engaging a peripheral edge portion of said bimetallic disc and supporting said disc above said first side of said flange; and a peripheral rim portion extending upwardly from said shoulder portion, said peripheral rim portion having a terminal edge, and a plurality of circumferentially spaced projections which extend upwardly from said terminal edge.

2. In the disc retainer of claim 1, said peripheral rim portion having eight circumferentially spaced projections.

3. The disc retainer of claim 1 comprising an integrally molded ceramic material.

4. A bimetallic disc assembly for a bimetallic disc-actuated thermostatic switch comprising:

a disc retainer comprising a circular flange portion having an axial bore extending therethrough, a circular shoulder portion extending upwardly from a first side of said flange portion, and a peripheral rim portion extending upwardly from said shoulder portion, said peripheral rim portion having a terminal edge and a plurality of circumferentially spaced projections which extend upwardly from said terminal edge;

a bimetallic disc received in assembled position on said disc retainer wherein a peripheral edge of said disc is supported on said shoulder portion; and a metallic cap received on said disc retainer for retaining said disc in assembled position and for securing said disc assembly to a body portion of said thermostatic switch, said retainer cap including an end wall portion having an enlarged central opening therein and a skirt portion deepening from said end wall portion and encircling said disc retainer, said end wall resting on said projections and retaining said disc in assembled position, said skirt portion being receivable on said body portion for securing said assembly thereto.

5. In the bimetallic disc assembly of claim 4, said disc retainer being integrally molded from a ceramic material.

6. In the bimetallic disc assembly of claim 4, said peripheral rim portion having typically eight circumferentially spaced projections.

* * * * *

UNITED STATES PATENT AND TRADEMARK OFFICE

CERTIFICATE OF CORRECTION

PATENT NO. : 5,296,834

DATED : March 22, 1994

INVENTOR(S) : Urban

It is certified that error appears in the above-indentified patent and that said Letters Patent is hereby corrected as shown below:

On the title page, item [73], change "Ellmwood" to --Elmwood--.

Signed and Sealed this

Twelfth Day of July, 1994

*Attest:*

Bruce Lehman

BRUCE LEHMAN

*Attesting Officer*

*Commissioner of Patents and Trademarks*